United States Patent [19]

Champenois, Jr.

[11] 4,055,287

[45] Oct. 25, 1977

[54] PROTECTIVE COVERINGS FOR SNOW SKI BINDINGS WITH CARRYING CASE

[76] Inventor: Charles E. Champenois, Jr., 22 Woodcrest Road, R.D. No. 1, Boonton, N.J. 07005

[21] Appl. No.: 723,782

[22] Filed: Sept. 16, 1976

[51] Int. Cl.[2] ..... B65D 45/04

[52] U.S. Cl. ..... 224/45 S; 150/52 R; 224/49; 280/11.37 K

[58] Field of Search ..... 224/45 S, 45 R, 5 Z, 224/1 R, 2 A, 49; 150/52 R, 12; 206/315; 280/11.37 A, 11.37 K; 294/27 H, 1 R, 2, 86 H

[56] References Cited

U.S. PATENT DOCUMENTS

| | | | |
|---|---|---|---|
| 2,234,180 | 3/1941 | Lackey et al. | 224/49 |
| 3,098,315 | 7/1953 | Bono | 224/45 R |
| 3,380,504 | 4/1968 | Green | 150/52 R |
| 3,737,171 | 6/1973 | Becker | 280/11.37 K |
| 3,780,920 | 12/1973 | Green | 224/49 |
| 3,851,689 | 12/1974 | Kohls | 150/52 R |
| 3,892,343 | 7/1975 | Warner | 224/45 S |
| 3,909,031 | 9/1975 | Schmaedeke et al. | 224/45 S X |
| 3,935,977 | 2/1976 | Bonnett | 224/45 S |

FOREIGN PATENT DOCUMENTS

| | | | |
|---|---|---|---|
| 1,332,131 | 6/1963 | France | 280/11.37 K |
| 83,251 | 3/1954 | Norway | 150/52 R |
| 240,478 | 12/1945 | Switzerland | 280/11.37 A |

*Primary Examiner*—Robert J. Spar
*Assistant Examiner*—Donald W. Underwood
*Attorney, Agent, or Firm*—Allegretti, Newitt, Witcoff & McAndrews

[57] ABSTRACT

An arrangement for protecting snow ski bindings from the elements. A pair of covers, each made of flexible sheet material with attached fasteners, encase and protect the bindings when the skis are being transported or are in storage. When not in use, the covers are folded and inserted into the pocket of a carrying case. A pair of handles attached to opposing edges of the carrying case pocket form a carrying sling to permit the skier to conveniently hand-carry both skis and ski poles to and from the slopes.

6 Claims, 15 Drawing Figures

Fig. 1
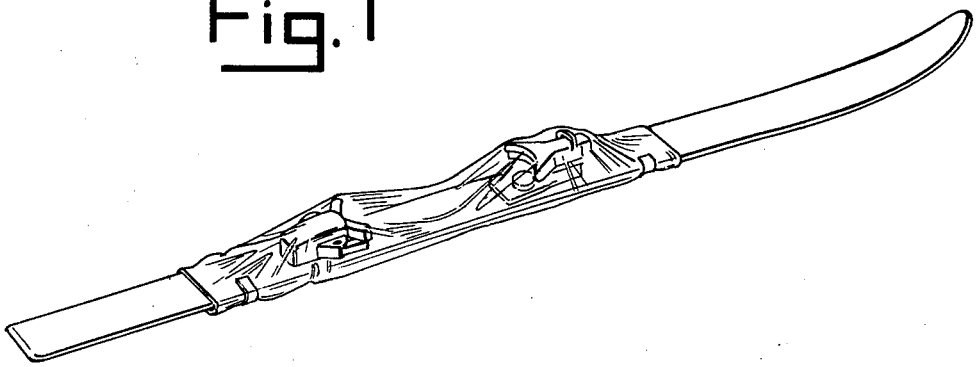
Fig. 2
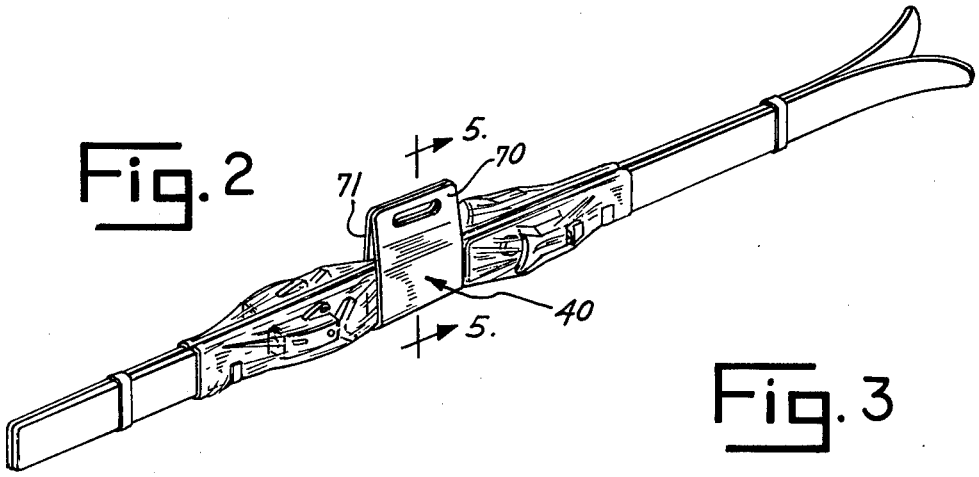
Fig. 3
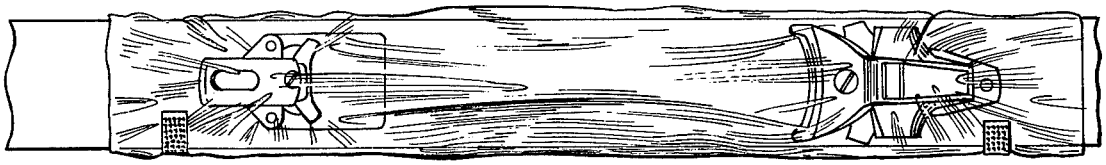
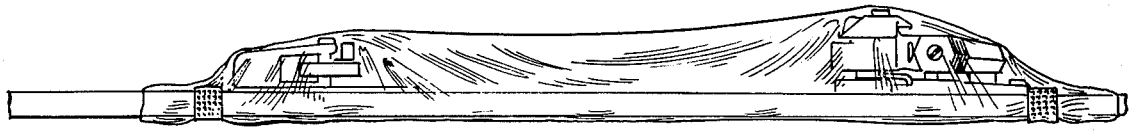
Fig. 4

PROTECTIVE COVERINGS FOR SNOW SKI BINDINGS WITH CARRYING CASE

SUMMARY OF THE INVENTION

The modern snow ski binding has contributed greatly to the safety of the sport. Designed to automatically release the skier's boot from the ski under a variety of potentially dangerous conditions, the binding significantly reduces the risk of injury faced by the skier. Such bindings are substantially more complex and expensive than earlier, simpler bindings, however, and deserve careful maintenance.

Rust, corrosion, and harmful deposits cannot only ruin the appearance of the binding, but impair its mechanical action and hence endanger the skier. It is accordingly an object of the present invention to protect snow ski bindings from the harmful effects of dust, road salts, dirt and other foreign matter which can damage the binding during transit or while the bindings are in storage.

It is a related object of the present invention to provide this needed protection in a way which is compatible with the needs and practices of the skier, making the care and use of the skis and bindings more convenient.

In a principal aspect, the present invention takes the form of a pair of ski binding covers which encase and protect the bindings. The covers are formed from flexible sheet material provided with separable fasteners for securing the covers to the skis. When not in use, the covers are folded and placed within a pouch provided with handles to serve a sling allowing the skier to conveniently carry his skis and ski poles by hand.

These and other objects, features and advantages of the present invention may be more clearly understood through a consideration of the following detailed description. In this description, reference will frequently be made to the attached drawings.

BRIEF DESCRIPTION OF THE DRAWINGS

FIG. 1 is a perspective view showing a ski with a protective cover encasing the ski binding.

FIG. 2 is a perspective view showing both skis with binding covers in place and the cover storage pouch positioned for use as a ski-carrying sling.

FIGS. 3 and 4 are top and side elevation views, respectively, of a single ski binding with the cover in place.

DETAILED DESCRIPTION

Figure 5:
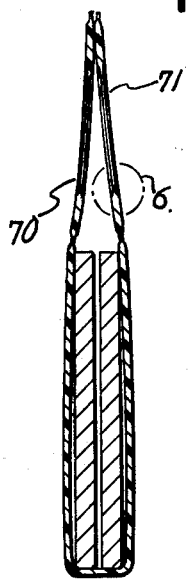
FIG. 5 is a cross-sectional view taken along the line 5—5 of FIG. 2.

The embodiment of the invention which is shown in the drawings is made up of a pair of ski-binding covers and a storage pouch for the covers which also serves as a sling which allows the skier to conveniently carry skis and ski poles by hand.

FIGS. 1, 3, 4 and 15 show the binding cover in place on the ski. The configuration of the cover itself is illustrated in FIGS. 9 through 13 of the drawings. As shown there, each cover is constructed of sheet material having a generally rectangular shape. The sheet is folded lengthwise and joined along the mid-portion of its opposing longer edges at a seam 21. The sheet material itself should be durable, waterproof and flexible. Suitable materials include rubber, leather and treated fabrics; although pliable vinyl or equivalent sheet materials are preferred. As seen in FIG. 10, the use of vinyl or the like simplifies construction due to the ease with which sheet material may be joined along the seam 21 by heat sealing.

Figure 14:
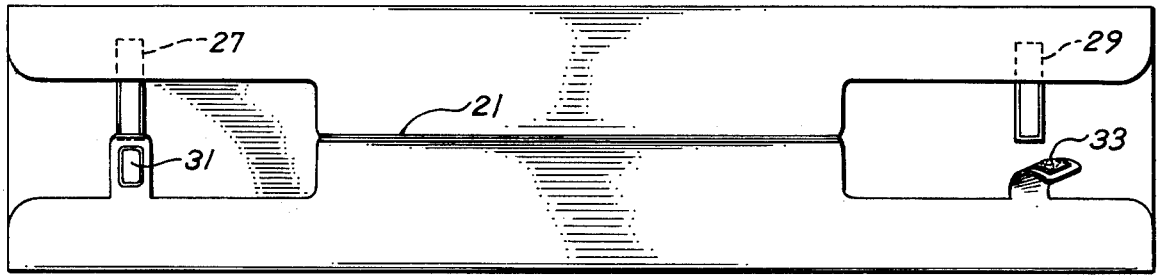
FIG. 14 is a bottom plan view of a binding cover folded as shown in FIG. 13.
Figure 15:
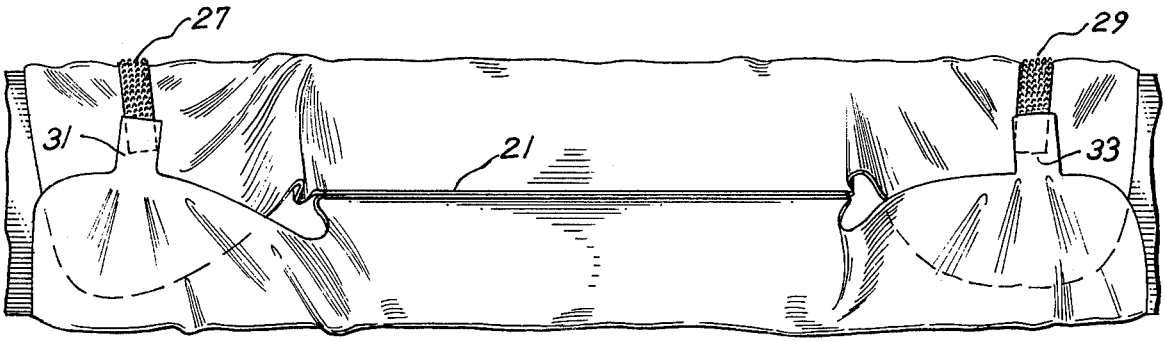
FIG. 15 is a view of the underside of the binding attached to a ski.

As best seen in FIGS. 10 and 14 of the drawings, the opposing longer edges of the sheet material are joined at seam 21 along a mid-portion only of the cover sheet and a portion of the sheet adjacent to seam 21 is cut away to form clefts indicated generally at 23 and 25. As a consequence the binding cover takes the general form of a central tubular portion flanked by end flaps. The central tubular portion is positioned over the ski binding and the end flaps are secured tightly to the ski itself by means of fasteners attached to the end flaps.

While a variety of fasteners can be employed, including snap fasteners, clasps, belt-and-buckle arrangements, and tied cords, the separable fastener of the fabric hook-and-loop type is preferred. Such fasteners include a matrix of hook-like members formed from filaments passing through a woven member forming a surface which engages with a matrix of loop-like members on another surface. A suitable fastener for this class is disclosed, for example, in U.S. Pat. No. 3,555,630 issued to Joseph R. Wylde and assigned to Velcro S.A., a corporation of Switzerland. As seen in FIG. 10, hook matrix surfaces are heat-sealed to the vinyl cover at 27 and 29 and are positioned to respectively engage with the loop matrix surfaces 31 and 33 attached to flaps. The manner in which the hook-and-loop fasteners are employed to secure the end flaps of the cover tightly around the ski is clearly seen in FIG. 15 of the drawings.

Figure 7:
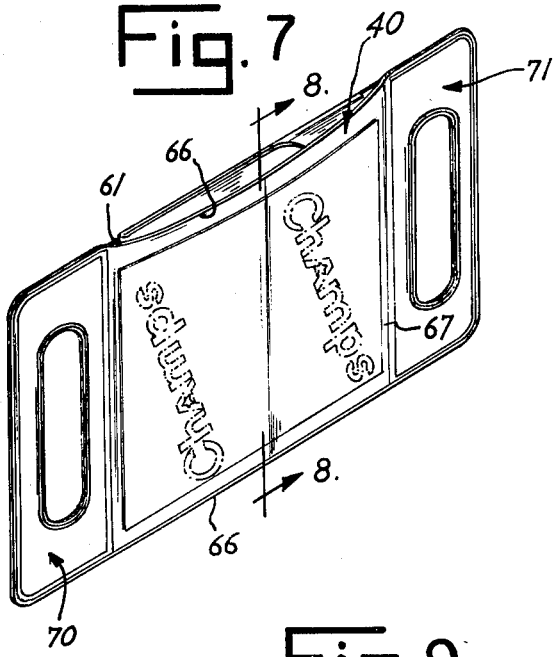
FIG. 7 is a perspective view of the combination cover storage pouch and ski-carrying sling.
Figure 8:
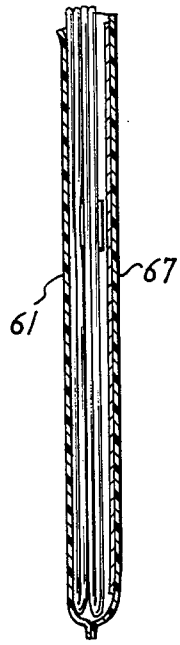
FIG. 8 is a cross-sectional view taken along the line 8—8 of FIG. 7.
Figure 9:
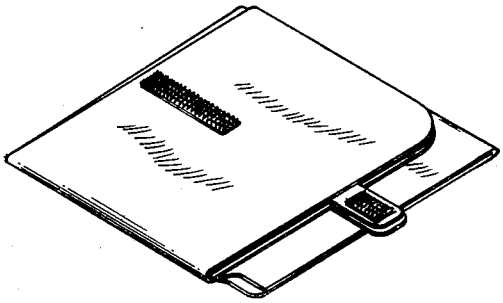
FIG. 9 is a perspective view of a binding cover folded for insertion into the storage pouch.
Figure 10:
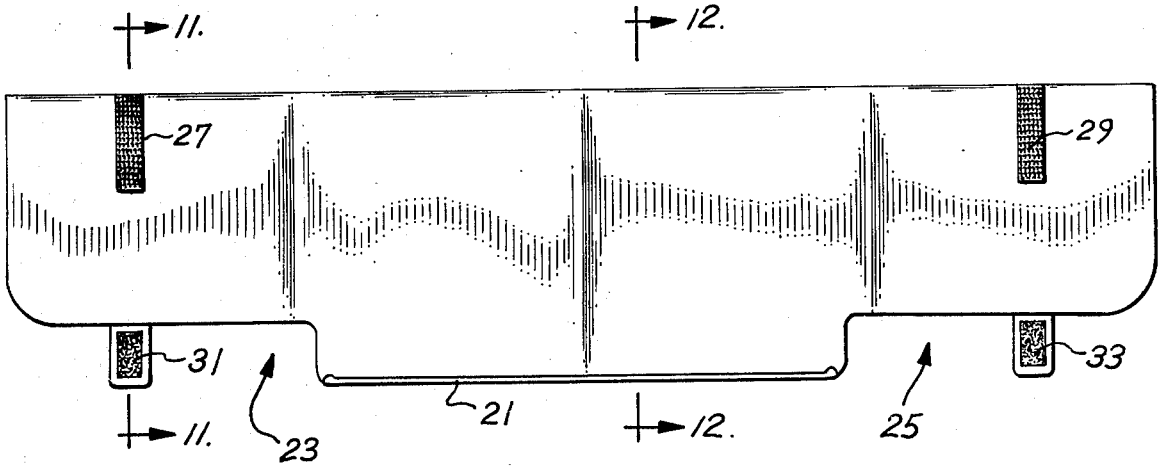
FIG. 10 is a plan view of a binding cover.
Figure 11:
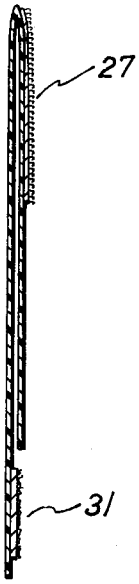
FIGS. 11 and 12 are cross-sections taken along the lines 11—11 and 12—12, respectively, of FIG. 10.
Figure 12:
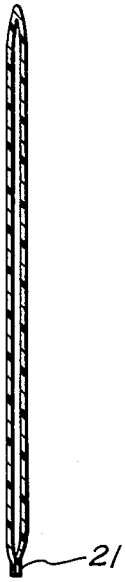
Figure 13:
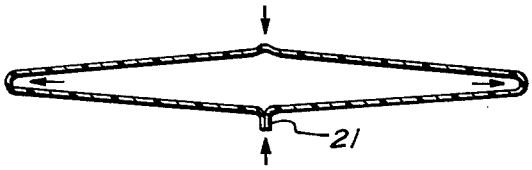
FIG. 13 is a cross-section illustrating how the sheath portion of the binding cover may be flattened to slip over the end of the ski and moved into position to surround the ski binding.

Each binding cover may be folded as shown in FIG. 9 into a substantially square configuration and inserted with the other cover similarly folded into the pocket of a storage pouch indicated generally at 40 in FIG. 7. Each cover is preferably formed from a single sheet having substantially rectangular shape approximately 16 inches wide and 32 inches long. As noted earlier, the single sheet is folded lengthwise and sealed along the mid-portion of its opposing longer edges forming a two-ply rectangle approximately 8 inches wide and 32 inches long, as illustrated in FIG. 10. The two-ply cover is then folded twice to form the eight-ply folded square configuration seen in FIG. 9. The pair of covers, one for each ski, is then conveniently inserted into the storage pouch, indicated at 40 in FIG. 7.

Figure 6:
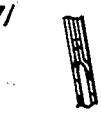
FIG. 6 is an enlarged cross-section showing details of the construction of the sling handle.

The storage pouch is also preferably constructed from sheet vinyl material. The pouch itself is approximately 8 inches by 8 inches; that is slightly larger than the folded covers it receives. As seen in FIG. 7, and in the detailed cross-sectional view of FIG. 6, the pouch is formed from a pair of vinyl sheets 61 and 62 and heat-sealed along the three edges indicated generally at 65, 66 and 67 in FIG. 7. The sheets 61 and 62 extend outwardly as flaps beyond the seams 65 and 67 to form handles indicated generally at 70 and 71. As seen in FIGS. 2 and 5, the combination of the pouch 40 and the handles 70 and 71 forms a sling which may be used to conveniently carry the skis and ski poles by hand. The ski-carring sling may be used with the covers in place around the ski bindings (as shown in FIG. 2) or with the covers off the skis, folded, and positioned within the pouch 40.

It is to be understood that the specific binding cover and storage pouch arrangement which has been described is merely illustrative of one application of the principles of the present invention and that numerous modifications may be made without departing from the true spirit and scope of the invention.

What is claimed is:

1. In combination, a pair of covers for protecting the bindings on snow skis, each of said covers being made of flexible sheet material and including fastening means for securing said sheet in an enveloping position around said bindings, each of said covers being foldable into a rectangular configuration, a carrying case comprising a rectangular pocket for receiving said covers, and handles attached to opposing sides of said pocket, said pocket and handles together forming a sling for carrying said snow skis.

2. The combination set forth in claim 1 wherein each of said covers is formed from a substantially rectangular sheet of material having a length of 4M units and a width of 2M units, the mid-portion of the opposing longer edges of said sheet being joined to form a central elongated tube section flanked on each end by an end flap section, said covers being foldable into a folded square of approximately M units by M units, and said rectangular pocket of said carrying case being approximately M units by M units.

3. The combination set forth in claim 2 wherein said units are inches and wherein M is greater than 6 and less than 10.

4. In combination, a pair of removable coverings for protecting snow-ski bindings, said coverings being constructed from a flexible sheet which may be arranged in a rectangular, multi-ply, folded configuration, a pouch having an interior compartment shaped to receive and conform to said pair of coverings in said folded configuration, and handles attached to opposing edges of said pouch to form a sling for carrying skis by hand.

5. The combination of claim 4 wherein opposing edges of said flexible sheet are joined along a mid-portion thereof to form a tube flanked by end-flaps.

6. The combination set forth in claim 5 including a separable fastener of the hook-and-loop type affixed to each of said end flaps for securing said end flaps tightly around a ski when said tube is centrally positioned around a binding on said ski.

* * * * *